US010226660B2

(12) United States Patent
Wilkins

(10) Patent No.: US 10,226,660 B2
(45) Date of Patent: Mar. 12, 2019

(54) WEIGHT STAND ASSEMBLY

(71) Applicant: Robert C. Wilkins, Hessmer, LA (US)

(72) Inventor: Robert C. Wilkins, Hessmer, LA (US)

( * ) Notice: Subject to any disclaimer, the term of this patent is extended or adjusted under 35 U.S.C. 154(b) by 145 days.

(21) Appl. No.: 15/260,761

(22) Filed: Sep. 9, 2016

(65) Prior Publication Data

US 2017/0072246 A1 Mar. 16, 2017

Related U.S. Application Data

(60) Provisional application No. 62/216,732, filed on Sep. 10, 2015.

(51) Int. Cl.
*A63B 21/062* (2006.01)
*A63B 21/072* (2006.01)
(Continued)

(52) U.S. Cl.
CPC ..... *A63B 21/078* (2013.01); *A63B 21/0626* (2015.10); *A63B 21/0726* (2013.01); *A63B 2225/093* (2013.01); *E04B 2001/2616* (2013.01)

(58) Field of Classification Search
CPC ..... A63B 21/00047; A63B 21/00058; A63B 21/00069; A63B 21/00072; A63B 21/00076; A63B 21/00178; A63B 21/00181; A63B 21/00185; A63B 21/002; A63B 21/0023; A63B 21/0615; A63B 21/0616; A63B 21/0617; A63B 21/062; A63B 21/0622; A63B 21/0624; A63B 21/0626; A63B 21/063; A63B 21/0632; A63B 21/068; A63B 21/072; A63B 21/0724; A63B 21/0726; A63B 21/078; A63B 21/0783; A63B 21/08; A63B 21/15; A63B 21/159; A63B 21/28; A63B 21/285; A63B 21/4023; A63B 21/4027; A63B 21/4029; A63B 21/4031; A63B 21/4033; A63B 21/4034; A63B 21/4035; A63B 21/4045; A63B 21/4047; A63B 21/4049; A63B 23/12; A63B 23/1209; A63B 23/1236; A63B 23/1245; A63B 2071/0054; A63B 2071/0063; A63B 2071/0072; A63B 2071/0081; A63B 2071/009;
(Continued)

(56) References Cited

U.S. PATENT DOCUMENTS 4,302,009 A * 11/1981 Johnson ..... A63B 21/4029 482/104
4,650,186 A * 3/1987 McCreery ..... A63B 21/078 482/104

(Continued)

*Primary Examiner* — Gary D Urbiel Goldner
(74) *Attorney, Agent, or Firm* — Ted M. Anthony

(57) ABSTRACT

A weight stand assembly for use in assisting a user prior to performing an exercise movement or repetition by way of holding exercise weights used by the user in a relatively stable and proper starting position for the user. More particularly, the weight stand assembly is retractable in that it pivotally falls in a relatively backwards direction away from the user and towards a ground surface after the exercise weights have been lifted by the user, thereby preventing injury and thus enhancing performance of the user by allowing the user to complete a full set of exercise repetitions without being inhibited by a placement and location of the weight stand assembly.

10 Claims, 6 Drawing Sheets

(51) Int. Cl.
*A63B 21/078* (2006.01)
*E04B 1/26* (2006.01)

(58) Field of Classification Search
CPC .... A63B 2208/0242; A63B 2208/0252; A63B 2225/09; A63B 2225/093; A63B 2244/09
See application file for complete search history.

(56) References Cited

U.S. PATENT DOCUMENTS 5,281,193 A * 1/1994 Colbo, Jr. ..... A63B 21/078 482/104
5,472,397 A * 12/1995 Ammoscato ..... A63B 21/078 482/104
5,509,876 A * 4/1996 Reyes ..... A63B 21/078 482/104
5,954,619 A * 9/1999 Petrone ..... A63B 21/078 482/104
6,447,433 B1 * 9/2002 Reyes ..... A63B 21/078 482/104
6,450,927 B1 * 9/2002 Ellis ..... A63B 21/078 482/104
7,226,400 B1 * 6/2007 Gedeon-Janvier ... A63B 21/072 482/104
8,740,760 B2 * 6/2014 York ..... A63B 21/078 482/104
8,834,329 B2 * 9/2014 Kelly ..... A63B 21/0724 482/104
9,248,335 B2 * 2/2016 Reyes ..... A63B 21/4029
9,327,161 B1 * 5/2016 Maher ..... A63B 21/078
9,597,539 B2 * 3/2017 Grider ..... A63B 17/04
2003/0232703 A1 * 12/2003 Webber ..... A63B 21/068 482/95
2004/0009855 A1 * 1/2004 Webber ..... A63B 21/068 482/94
2007/0082795 A1 * 4/2007 Murray ..... A63B 21/078 482/104
2010/0022362 A1 * 1/2010 MacDonald ..... A63B 21/0615 482/94
2014/0187391 A1 * 7/2014 Kelly ..... A63B 21/0724 482/104

* cited by examiner

WEIGHT STAND ASSEMBLY

CROSS REFERENCES TO RELATED APPLICATION

Priority of U.S. Provisional Patent Application Ser. No. 62/216,732, filed Sep. 10, 2015, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

Field of the Invention

The present invention pertains to a weight stand assembly for use in assisting a user prior to performing an exercise movement or repetition by holding said user's exercise equipment (such as, for example, free weights, hand weights, dumbbells, or bar bells) in a relatively stable and proper starting position for said user. More particularly, the present invention pertains to a retractable weight stand assembly that pivotally falls (typically in a relatively backwards direction away from said user and generally towards a ground or other underlying surface) after said exercise equipment, or weights, have been lifted by said user, thereby preventing injury and thus enhancing performance of said user by allowing said user to complete a full set of exercise repetitions without being inhibited by the placement and location of the weight stand.

Brief Description of the Prior Art

Existing weight storage systems generally require a user to lift weights (such as, for example, hand weights or dumbbells) from a relatively distant rack or other staging area and then transport said weights to a weight bench or other desired location for use during weight resistance exercises. Ideally, it is preferable to begin a resistance training exercise from a position that is closer to a bench or other starting point.

Moreover, once a set of exercises commences, conventional methods typically involve a user lifting weights from a ground or other underlying surface and then positioning said weights into a proper form in order to begin said exercise set. As a result a user is already exerting a relatively large amount of energy in order to initially lift said weights and get into a proper position, prior to performing an exercise movement and repetition. Thus, said user has a relatively less amount of energy to use to perform said exercise repetitions, and therefore, may not have enough strength for a remainder of an exercise set.

Conventional weight stands permit weights to be staged closer to a weight bench or other location prior to commencement of an exercise. However, such conventional weight stands must typically be positioned behind or to the side of a user prior to commencement of an exercise; such placement is necessary to prevent a weight from coming into contact with said weight stand while a user performs an exercise movement or repetition. Such placement can require a user to lift said weights from a relatively unnatural and awkward position in order to commence an exercise, thereby increasing the risk of injury.

As a result, such conventional weight stands negatively impact the exercise process due to their inconvenient location or placement, as well as the tendency to be in the way during performance of exercise repetitions. Thus, there is a need for a weight stand that permits staging of weights in a convenient and advantageous location prior to commencement of exercises, while not being in the way of an exercise movement and permitting a full range of motion to a user.

SUMMARY OF THE INVENTION

The present invention comprises a weight stand assembly that beneficially allows a user to increase an amount of weight that is being lifted or to increase a number of repetitions of an exercise movement by allowing the user to be able to lift said weights, such as, for example, hand weights, from a beneficially and substantially higher starting point of an exercise lift, and thus, from a position of strength. By not having to begin the exercise movement from a ground surface, or a relatively lower starting point, said user is able to conserve his or her strength and energy for a remainder of the exercise set, and thus potentially perform more repetitions of said exercise movement.

The weight stand assembly comprises a stand member, having a first and second top member, side insert members, base members, and inner panel members cooperating to form an inner space. First and second top members comprise a substantially indented receiving end that allows for said hand weights to be securely placed in a stable position prior to a user performing an exercise movement. When said hand weights are securely positioned within receiving ends of first and second top members, stand member is thus situated in a relatively stable and balanced upright position. Further, first top member comprises a substantially vertical indentation for use in allowing a user's arm to fit within inner space of stand member, and thus, properly grasp said resting hand weights, without contacting any other component of said stand member. As a result, said user is able to freely grasp said hand weights prior to performing an exercise movement without being hindered by said weight stand assembly. Additionally, stand member comprises a plurality of side insert members that can be attachably connected and added to weight stand assembly, as needed. As a result, side insert members avow a user to be able to adjust a desired height of said apparatus, thereby being able to tailor said weight stand assembly to each particular user.

The present invention represents an improvement over a conventional exercise device because it allows for a user to be able to start an exercise movement from a position of strength, while then providing a mechanism for moving out of a user's way once he or she begins the exercise repetitions. For example, the weight stand assembly comprises a lever that is positioned along a base end of said stand member. Said lever comprises a load that allows said stand member to retract and fall away from a user in a relatively backward direction towards a ground surface once said hand weights have been lifted from stand member.

As a result, once the weights have been lifted, the center of mass of said weight stand assembly shifts due to said lever having a desired load, thereby causing weight stand assembly to retract and fall away from said user. Thus, said retractable weight stand assembly is designed and intended to fall away from a user in a relatively backwards direction when said user lifts said weights from said stand member in order to perform an exercise set, thereby allowing a user to perform multiple exercise repetitions in said exercise set without user potentially making direct contact with said weight stand assembly during a course of an exercise movement.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
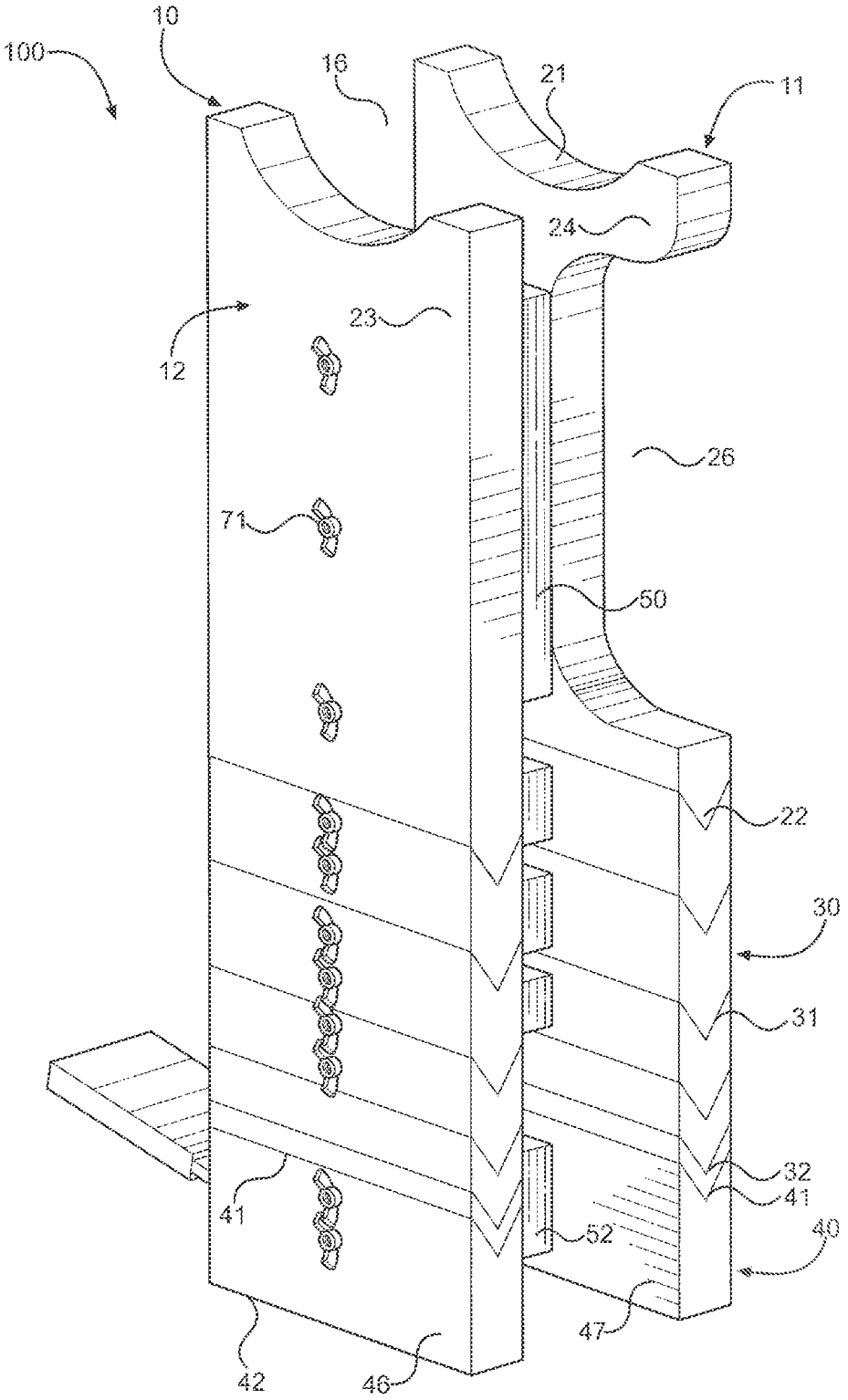
FIG. 1 depicts a front perspective view of a preferred embodiment of a weight stand assembly of the present invention.

Referring to the drawings, FIG. 1 depicts a perspective view of a weight stand assembly 100 of the present invention generally comprising at least one stand member 10. Stand member 10, or body member, comprises a substantially rigid frame that can be manufactured from a solid structural material, such as, for example, plastic, composite, wood or a simulated wood product, or any other substantially solid material exhibiting like characteristics. Moreover, weight stand assembly 100 can be assembled in a variety of different dimensions, thereby allowing a user to be able to custom fit weight stand assembly 100 in order to meet any desired height requirements.

In a preferred embodiment, stand member 10 generally comprises a plurality of panels that are braced and connected via a plurality of bolts 71, mechanical fasteners, adhesive, or any other similar attachment means. Still referring to FIG. 1, stand member 10 generally comprises a first 11 and a second 12 substantially planar top members, substantially planar side insert members 30, substantially planar base members 40, and substantially planar inner panel members 50. Said top members 11, 12 are oriented substantially parallel to each other and are orientated substantially perpendicular to said inner panel members 50, thus cooperating to form an inner space 16 of weight stand assembly 100. Further, top members 11, 12 are oriented adjacent to side insert members 30, wherein side insert members 30 are oriented adjacent to base members 40, thereby axially aligning top members 11, 12, side insert members 30, and base members 40 into a relatively straight configuration.

Top members 11, 12 each comprise a top receiving end 21 and a base end 22, wherein receiving end 21 comprises a substantially semi-circular shaped groove indention, or cradle, thereby allowing for a location for a hand weight, or any other similar load, to be placed on and fully secured within stand member 10. Base end 22 of top member 11, 12 tapers in a relatively downward direction towards a substantial mid-point, thereby creating a relatively slanted and substantially "V" shaped edge. Thus, pointed edge of base end 22 allows top member 11, 12 to be properly aligned with and attachably connected and secured to side insert members 30.

Additionally, as illustrated in FIG. 1, first top member 11 comprises a substantially vertical indentation 26, or notch, that is located along a y-axis of first top member 11. Vertical indentation 26 allows for a user's arm to beneficially fit within an open space of said notch 26, thereby allowing said user to position his or her arm within said inner space 16 of weight stand assembly 100 of the present invention, and thus, be able to grasp a weight that is resting on receiving end 21 of first 11 and second 12 top members. Further, top members 11, 12 comprise a first (outer) planar surface 23 and a second (inner) planar surface 24, wherein top members 11, 12 further comprise a plurality of apertures 70 for use as a means of connection between top members 11, 12 and inner panel members 50.

In a preferred embodiment, side insert members 30 each comprise a top receiving end 31 and a bottom end 32. Receiving end 31 of side insert members 30 comprises a substantially downward sloping channel, and bottom end 32 of side member 30 tapers in a substantially downward direction, thus creating a relatively slanted and substantially "V" shaped edge, wherein bottom end 32 of one side insert member 30 mates with receiving end 31 of an additional side insert member 30, thereby creating a relatively proper fit and a secure connection. Further, side insert members 30 comprise a variety of different height measurements, including, but not limited to, five (5) inches, four (4) inches, two (2) inches, or one (1) inch block lengths, thereby allowing a user to custom fit the weight stand assembly 100 as necessary by adding a variety of different number or sizes of side insert members 30 in order to properly tailor weight stand assembly 100 to said user's specific requirements. As a result, side insert members 30 allow weight stand assembly 100 to have up to approximately seventeen (17) inches of adjustment in order to properly accommodate an individual user's height requirements.

Base members 40 each comprise a top receiving end 41 and a base end 42, wherein receiving end 41 comprises a substantially downward sloping edge, and base end 42 of base member 40 comprises a relatively planar surface. Receiving end 41 of base member 40 allows for a bottom end 32 of a side insert member 30 to mate and properly fit within receiving end 41 of base member 40, thus allowing for a plurality of side insert members 30 to be placed and stacked on top of base member 40. As a result, a user is able to create a desired height of weight stand assembly 100 by adjusting the number of side insert members 30 that can be stacked within stand member 10. Base members 40 further comprise an outer surface 46 and an inner surface 47, wherein a plurality of apertures are located within base member 40 for use as a means of connection between base members 40 and bottom inner panel member 52.

In a preferred embodiment, top members 11, 12, side insert members 30, and base members 40 each comprise a plurality of apertures 70, wherein apertures 70 allow for a means of connection between top members 11, 12, side insert members 30, base members 40, and inner panel members 50 by way of bolts 71.

Figure 2:
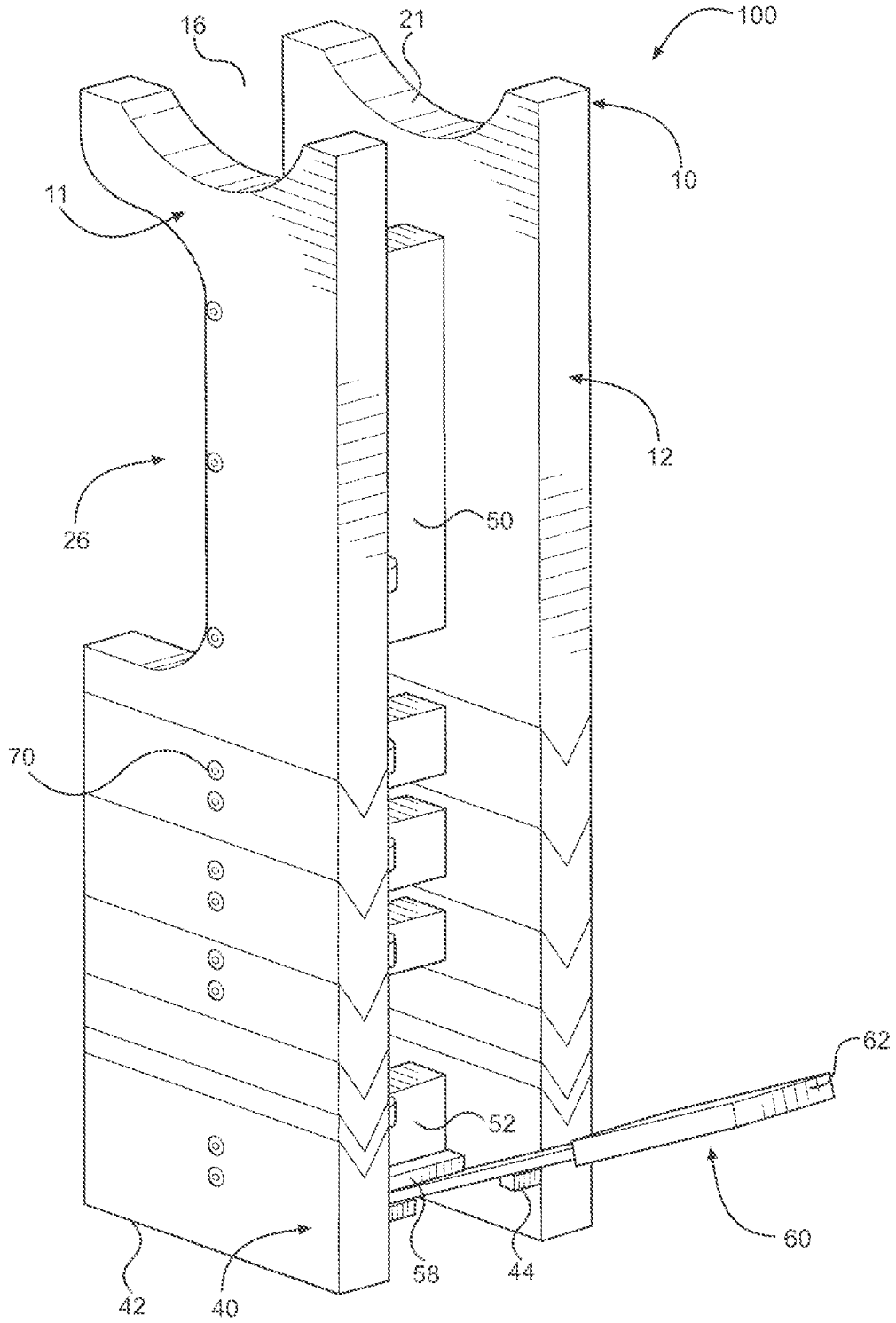
FIG. 2 depicts rear perspective view of a preferred embodiment of a weight stand assembly of the present invention.

FIG. 2 depicts a rear perspective view of weight stand assembly 100 of the present invention generally comprising stand member 10 with lever 60. Stand member 10 comprises first 11 and second 12 top members, side insert members 30, base members 40, and inner panel, or central spacer, members 50. First top member 11 and second top member 12 each comprise receiving end 21 for use in providing a groove or indentation for a weight to be placed and secured upon stand member 10 prior to a user performing an exercise movement. Further, first top member 11 comprises vertical indentation 26, or opening, for use in allowing a user's arm to fit within inner space of indentation 26, and ultimately, inner space 16 of weight stand assembly 100, in order to properly grasp said hand weight located on receiving ends 21 of first 11 and second 12 top members.

Still referring to FIG. 2, stand member 10 generally comprises a mount 58, a lever 60, and a fulcrum 65. Mount 58 comprises a substantially rigid platform member that is attachably connected and located towards a base end of bottom inner panel member 52. Lever 60 comprises a substantially planar configuration, having a first end 61 and a second end 62, and can be supported on mount 58 of weight stand assembly 100. First end 61 of lever 60 comprises a substantially slanted edge, thereby allowing lever 60 to rest upon mount 58 and to be oriented in a relatively angled position as lever 60 is supported on mount 58. Additionally, base member 40 comprises a rear support 44 that assists mount 58 in properly orienting lever 60 in a desired position.

Second end 62 of lever 60 comprises a load, or additional weight, thus providing a desired amount of weight towards a rear end of stand member 10 in order to overcome the structural weight of weight stand assembly 100, thereby causing weight stand assembly 100 to fall in a relatively backwards direction towards a ground surface if a hand weight is not located in receiving end 21 of first 11 and second 12 top members. Additionally, fulcrum is located at a rear, base end 42 of base member 40, thereby defining a point at which lever 60 is balanced when a force and a desired amount of weight are exerted on weight stand assembly 100 of the present invention.

A load amount that is necessary for lever 60 is dependent on the particular material of manufacture of weight stand assembly 100. For example, by way of illustration, but not limitation, if weight stand assembly 100 is manufactured from a plastic material, a desired load amount will be approximately seven (7) pounds, thus weighing enough to overcome the structural weight of weight stand assembly 100 itself. Further, by way of illustration, but not limitation, load can be added to lever 60 by infusing a metal material, or any other similarly weighted material, into lever 60 to give it an additional weight, or lever 60 can have a means of attaching a weight plate to top end of lever 60, thus allowing a user to add a desired amount of weight to lever 60 as necessary.

Figure 3:
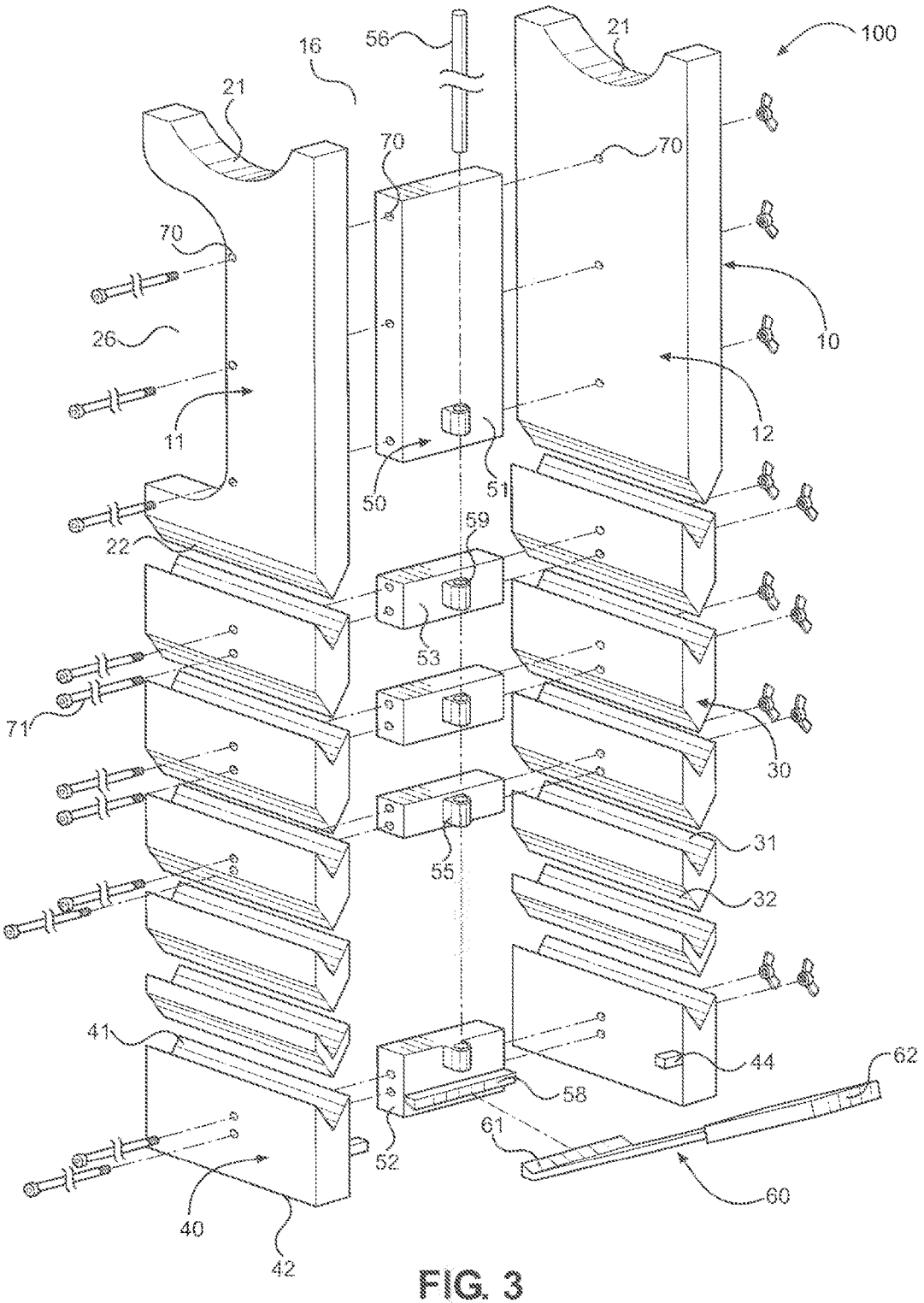
FIG. 3 depicts an exploded view of a preferred embodiment of a weight stand assembly of the present invention.

FIG. 3 depicts an exploded view of weight stand assembly 100 of the present invention comprising top members 11, 12, side insert members 30, inner panel members 50, and base members 40. Stand member 10 comprises first 11 and second 12 top members, side insert members 30, base members 40, and inner panel members 50. First top member 11 and second top member 12 each comprise receiving end 21 for use in providing an indented location for a hand weight to be placed and secured upon stand member 10 prior to a user performing an exercise movement. Further, first top member 11 comprises vertical groove 26 for use in allowing a user's arm to fit within inner space of groove 26, and ultimately, inner space 16 of weight stand assembly 100, in order to properly grasp said hand weight located on receiving ends 21 of first 11 and second 12 top members.

Further, stand member 10 comprises mount 58 and lever 60, wherein mount 58 is located towards a base end of bottom inner panel member 52. Lever 60 comprises first end 61 and second end 62, wherein first end 61 of lever 60 comprises slanted edge that allows lever 60 to rest upon mount 58 and to be oriented in a relatively angled position as lever 60 is supported on mount 58. Moreover, base member 40 comprises rear support 44 having a substantially rigid platform member, wherein rear support 44 assists mount 58 in properly positioning lever 60. Additionally, second end 62 of lever 60 comprises an additional load that causes the structural weight of weight stand assembly 100 to be unevenly distributed when a hand weight is not resting on receiving end 21 of first 11 and second 12 top members, thus, ultimately causing weight stand assembly 100 to tip in a relatively backwards direction towards lever 60 when said hand weight is removed.

Still referring to FIG. 3, stand member 10 generally comprises a plurality of inner panel members 50, including, but not limited to, a top inner panel 51, a bottom inner panel 52, and a plurality of inner insert panels 53, wherein top inner panel 51, bottom inner panel 52, and inner insert panels 53 are axially aligned in a relatively vertical direction. Top inner panel 51 is located relatively perpendicular to first 11 and second 12 top members, thereby attachably connecting first 11 and second 12 top members; bottom inner panel 52 is located relatively perpendicular to base members 40, thereby attachably connecting base members 40. Additionally, inner insert panels 53 are relatively perpendicular to side insert members 30, thereby attachably connecting side insert members 30 and thus creating a single stand member unit 10.

In a preferred embodiment, inner panel members 50 each comprise a substantially cylindrical bracket 55, wherein each bracket 55 is located on and molded to a rear surface of each inner panel member 50. Bracket 55 comprises an inner cavity 59, thus allowing a substantially cylindrical rod 56 to be received within inner cavity 59 of bracket 55, thereby providing a means of attachment and connection for inner panel members 50, and ultimately, for stand member 10 of weight stand assembly 100.

Figure 4B:
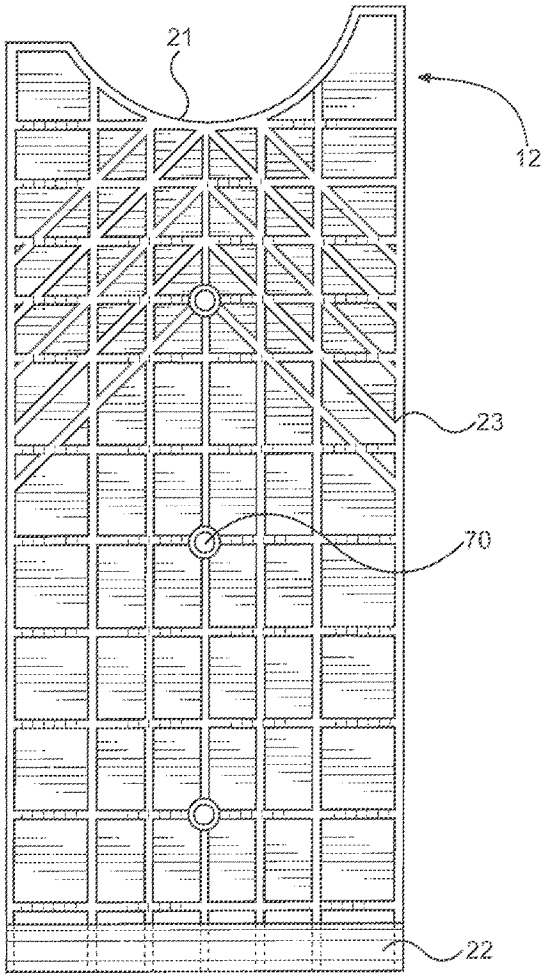
FIG. 4B depicts an alternate side view of a preferred embodiment of a top member of a weight stand assembly of the present invention.
Figure 4A:
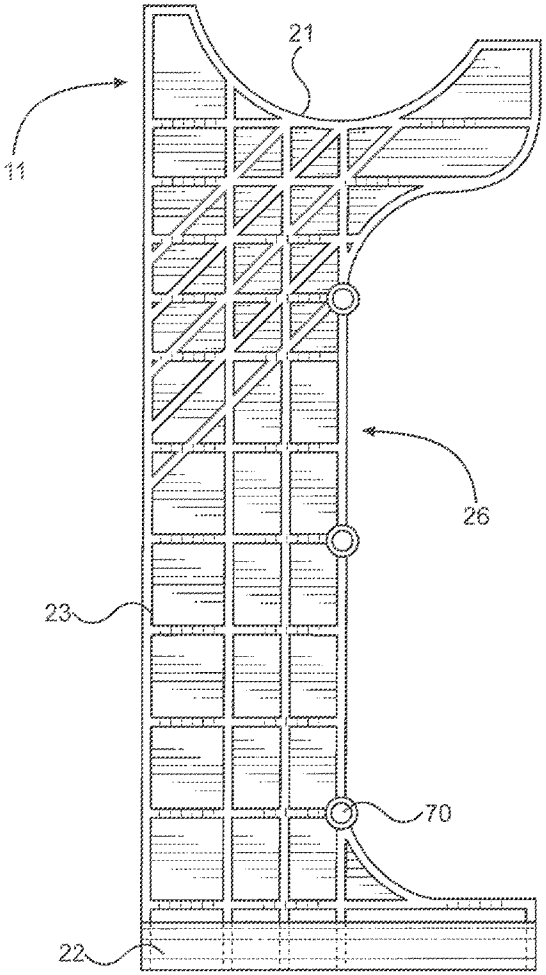
FIG. 4A depicts a side view of a preferred embodiment of a top member of a weight stand assembly of the present invention.

FIG. 4A depicts a side view of first top member 11 of weight stand assembly 100 of the present invention. In a preferred embodiment, as illustrated in FIG. 4A, first top member 11 of weight stand assembly 100 of the present invention comprises a desired structural design on first outer surface 23 for use in evenly dispersing a weight of the structural material used to configure weight stand assembly 100. As a result, the desired structural design allows the weight of weight stand assembly 100 to be evenly dispersed across the entire assembly, therefore creating a stable and evenly weighted device prior to adding a lever having a specific load. FIG. 4B depicts a side view of second top member 12 of weight stand assembly 100 of the present invention illustrating a desired structural design on first outer surface 23 for use in evenly dispersing a structural weight of weight stand assembly 100. In a preferred embodiment, although not depicted in FIG. 4B, the remaining component parts of weight stand assembly 100, including, but not limited to, side insert members 30, base members 40, and inner panel members 50, also comprise a desired structural design in order to evenly disperse the weight of the structural material across the entirety of said weight stand assembly 100 of the present invention.

Figure 5A:
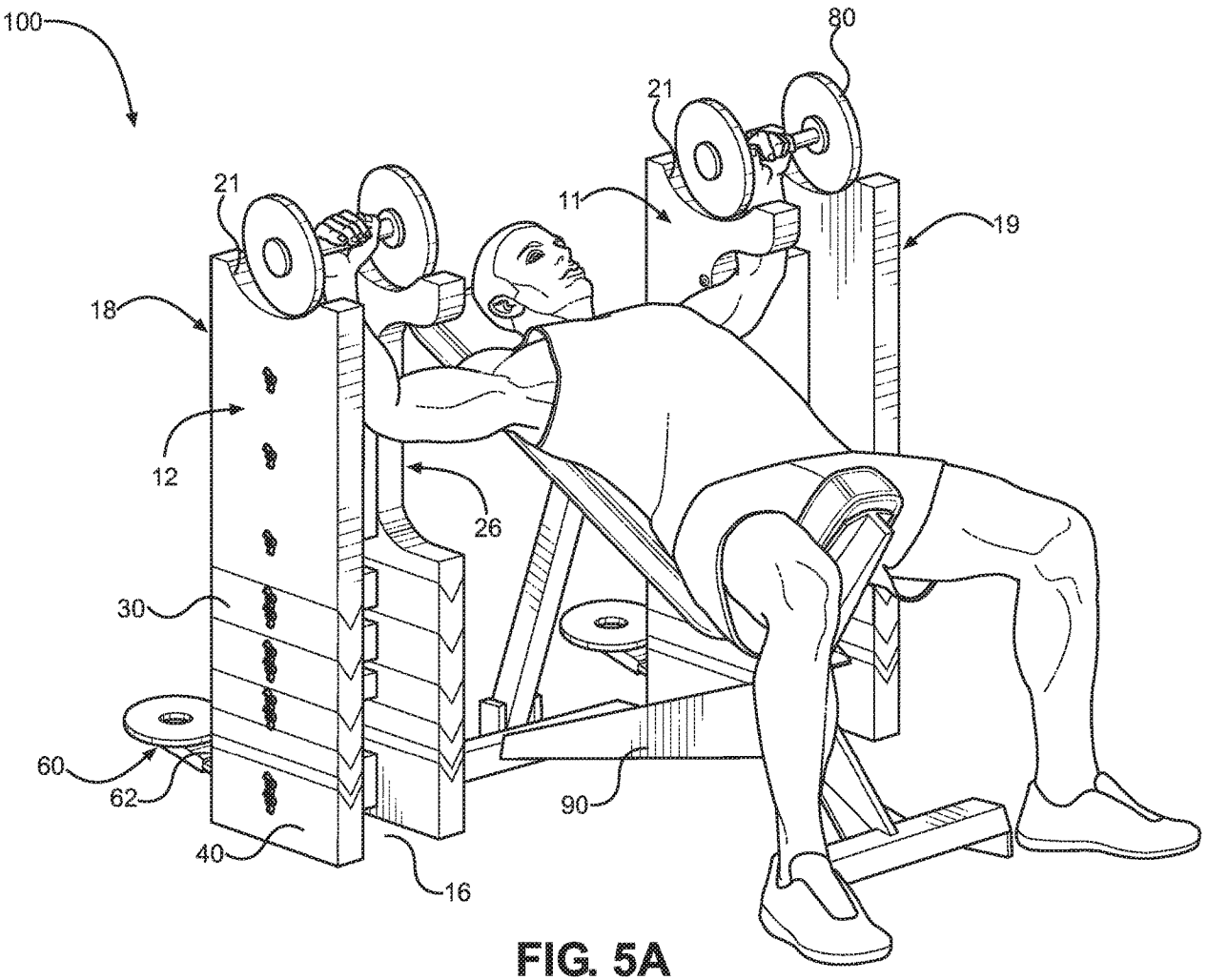
FIG. 5A depicts a perspective view of a preferred embodiment of a user utilizing weight stand assembly of the present invention prior to performing an exercise movement.

FIG. 5A depicts a side perspective view of a user utilizing weight stand assembly 100 of the present invention and gripping a plurality of hand weights 80 prior to beginning an exercise repetition. In a preferred embodiment, when in operation, weight stand assembly 100 of the present invention comprises a plurality of stand members 10—typically, a left stand member 19 and a right stand member 18, wherein left stand member 19 is disposed on a left side of a user and a right stand member 18 is disposed on a right side of said user. Further, left 19 and right 18 stand members can be positioned on opposing sides of an exercise bench 90 (such as, for example, a free-standing incline bench, a free-standing decline bench, or any other similar exercise bench), or left 19 and right 18 stand members can be positioned on opposing skies of a standing user.

Additionally, when in operation, a user can position his or her arms through inner space 26 of first top member 11, thereby being able to position his or her hands through inner space 16 of stand member 10, and ultimately, be able to grip a weight 80, such as, for example, a hand weight, that is resting on receiving ends 21 of first 11 and second 12 top members of both left 19 and right 18 stand members.

In a preferred embodiment, when a hand weight 80 is placed on receiving end 21 of first 11 and second 12 top members, a total mass of stand member 10 combined with a bad of said hand weight 80 is relatively too great for a gravitational force to pull stand member 10 towards a ground surface, or a relatively lower point, even though lever 60 comprises a desired load amount. Thus, hand weights 80 provide enough mass to stand member 10 to be able to overcome a load amount of lever 60, thereby preventing stand member 10 from retracting and tilting towards lever 60, and thus, a ground surface. As a result, as illustrated in FIG. 5A, left 19 and right 18 stand members of weight stand assembly 100 of the present invention are relatively stable and will generally remain in a relatively vertical and upright position, as long as said hand weights 80 remain positioned within receiving ends 21 of first 11 and second 12 top members.

Figure 5B:
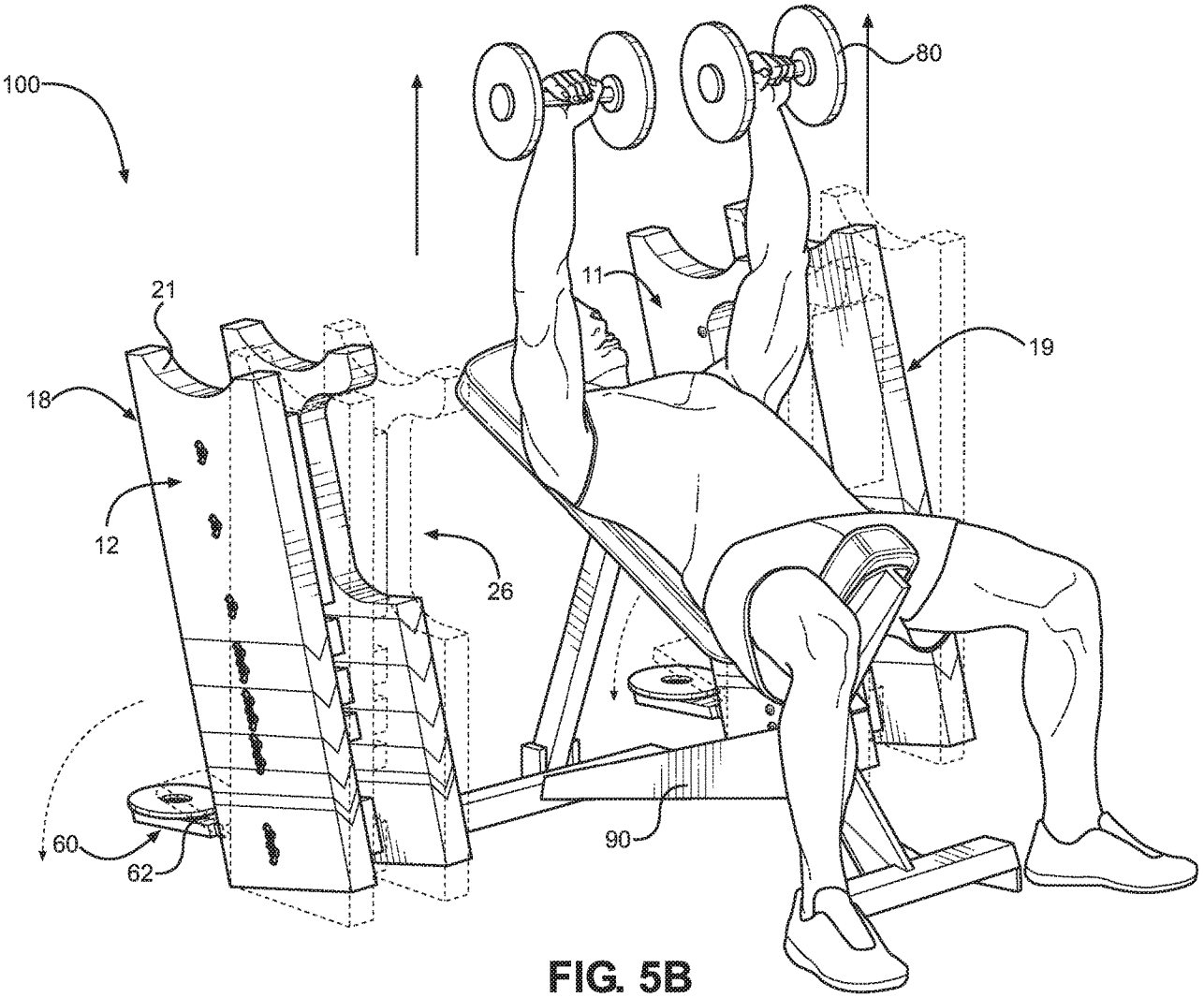
FIG. 5B depicts a perspective view of a preferred embodiment of a user performing an exercise movement and setting weight stand assembly of the present invention into motion.

FIG. 5B depicts a side perspective view of a user gripping a plurality of hand weights 80 while performing an exercise movement, wherein retractable weight stand assembly 100 is in motion in a relatively downward direction. In a preferred embodiment, as depicted in FIG. 5B, when a user lifts said hand weights 80 off of receiving ends 21 of first 11 and second 12 top members in order to perform an exercise movement and repetition, a center of mass of stand members 19, 18 of weight stand assembly shifts towards a rear end of stand members 19, 18. The center of mass of stand members 19, 18 shifts as a result of the additional load of hand weights 80 no longer being combined with the structural weight of stand members 19, 18 and due to lever 60 having a desired load amount that shifts the weight disbursement of stand members 19, 18, thereby causing fulcrum to pivot, and ultimately, causing stand members 19, 18 of weight stand assembly 100 to retract and fall away from a user towards a ground surface due to a gravitational force acting upon weight stand assembly 100.

Additionally, in a preferred embodiment, as a user lifts said hand weights 80 off of receiving ends 21 of first 11 and second 12 top members, and ultimately, causes stand members 19, 18 of weight stand assembly 100 to tilt away from said user, user is then able to properly perform a desired number of exercise repetitions of a particular exercise without being hindered by weight stand assembly 100 itself. As a result, retractable weight stand assembly 100 of the present invention allows a user to easily lift hand weights 80 from a position of strength, as opposed to lifting weights from an unnatural position or from a ground surface, and allows a user to perform a desired number of exercise repetitions without coming in direct contact with said weight stand assembly 100.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A retracting weight stand for exercising from a bench, the retracting weight stand comprising: a) an elongate body member being free-standing and having a base and a top, wherein said elongate body member is spaced apart from and decoupled from said bench b) a cradle disposed at said top of said elongate body member and adapted to hold a dumbbell weight;

c) a lever having a first end and a second end, wherein said first end is attached to said elongate body member; and d) a load disposed at said second end of said lever, wherein said elongate body member is maintained in a substantially vertical orientation when said dumbbell weight is received in said cradle, and wherein said elongate body member is adapted to tilt from said substantially vertical orientation when said dumbbell weight is removed from said cradle.

2. The retracting weight stand of claim 1, wherein said elongate body member further comprises:

a) a first substantially planar side member; and b) a second substantially planar side member, wherein said first and second substantially planar side members are oriented parallel to each other.

3. The retracting weight stand of claim 2, further comprising a central spacer member disposed between said first and second substantially planar side members.

4. The retracting weight stand of claim 3, wherein said central spacer member comprises a planar member oriented substantially perpendicular to said first and second substantially planar side members.

5. A method of weight training from a bench, said method comprising: a) placing a dumbbell weight on a retracting weight stand, said retracting weight stand further comprising: i) an elongate body member being free-standing and having a base and a top, wherein said elongate body member is spaced apart from and decoupled from said bench;

ii) a cradle disposed at said top of said elongate body member adapted to hold said dumbbell weight;

iii) a lever having a first end and a second end, wherein said first end is attached to said elongate body member;

iv) a load disposed at said second end of said lever; and b) removing said dumbbell weight from said retracting weight stand, thereby causing said retracting weight stand to tilt.

6. The method of claim 5, wherein removing said dumbbell weight from said retracting weight stand causes a center of gravity of said retracting weight stand to change.

7. The method of claim 5, wherein said elongate body member is maintained in a substantially vertical orientation when said dumbbell weight is received in said cradle, and wherein said elongate body member tilts from said substantially vertical orientation when said dumbbell weight is removed from said cradle.

8. The method of claim 5, wherein said elongate body member further comprises:

a) a first substantially planar side member; and b) a second substantially planar side member, wherein said first and second substantially planar side members are oriented parallel to each other.

9. The method of claim 8, wherein said elongate body member further comprises a central spacer member disposed between said first and second substantially planar side members.

10. The method of claim 9, wherein said central spacer member further comprises a planar member oriented substantially perpendicular to said first and second substantially planar side members.

* * * * *